US006478540B2

(12) United States Patent
Abuaf et al.

(10) Patent No.: US 6,478,540 B2
(45) Date of Patent: Nov. 12, 2002

(54) BUCKET PLATFORM COOLING SCHEME AND RELATED METHOD

(75) Inventors: Nesim Abuaf, Lincoln City, OR (US); Kevin Joseph Barb, Halfmoon, NY (US); Sanjay Chopra, Greenville, SC (US); David Max Kercher, Ipswich, MA (US); Iain Robertson Kellock, Simpsonville, SC (US); Dean Thomas Lenahan, Cincinnati, OH (US); Sankar Nellian, Mauldin, SC (US); John Howard Starkweather, Sharonville, OH (US); Douglas Arthur Lupe, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 36 days.

(21) Appl. No.: 09/739,445

(22) Filed: Dec. 19, 2000

(65) Prior Publication Data

US 2002/0076324 A1 Jun. 20, 2002

(51) Int. Cl.[7] ..... F01D 5/18
(52) U.S. Cl. ..... 416/1; 416/97 R; 416/193 A
(58) Field of Search ..... 416/1, 97 R, 97 A, 416/193 A, 248, 96 A; 415/115, 116, 175, 178

(56) References Cited

U.S. PATENT DOCUMENTS

| | | | | |
|---|---|---|---|---|
| 3,800,864 A | * | 4/1974 | Hauser et al. | 165/186 |
| 3,936,227 A | | 2/1976 | Wojcik | 416/95 |
| 3,967,353 A | | 7/1976 | Pagnotta et al. | 29/889.21 |
| 4,012,167 A | | 3/1977 | Noble | 416/97 A |
| 4,017,213 A | * | 4/1977 | Przirembel | 415/115 |
| 4,244,676 A | | 1/1981 | Grondahl et al. | 416/92 |
| 4,531,889 A | | 7/1985 | Grondahl | 416/96 R |
| 4,712,979 A | * | 12/1987 | Finger | 415/115 |
| 5,738,489 A | | 4/1998 | Lee | 415/177 |
| 6,120,249 A | * | 9/2000 | Hultgren et al. | 416/193 A |
| 6,158,962 A | | 12/2000 | Lee et al. | 416/193 A |
| 6,176,678 B1 | | 1/2001 | Brainch et al. | 416/97 R |

OTHER PUBLICATIONS

"39$^{th}$ GE Turbine State–of–the–Art Technology Seminar", Tab 1, ""F" Technology—the First Half–Million Operating Hours", H.E. Miller, Aug. 1996.

"39th GE Turbine State–of–the–Art Technology Seminar", Tab 2, "GE Heavy–Duty Gas Turbine Performance Characteristics", F. J. Brooks, Aug. 1996.

"39th GE Turbine State–of–the–Art Technology Seminar", Tab 3, "9EC 50Hz 170–MW Class Gas Turbine", A. S. Arrao, Aug. 1996.

"39th GE Turbine State–of–the–Art Technology Seminar", Tab 4, "MWS6001FA—An Advanced–Technology 70–MW Class 50/60 Hz Gas Turbine", Ramachandran et al., Aug. 1996.

"39th GE Turbine State–of–the–Art Technology Seminar", Tab 5, "Turbomachinery Technology Advances at Nuovo Pignone", Benvenuti et al., Aug. 1996.

"39th GE Turbine State–of–the–Art Technology Seminar", Tab 6, "GE Aeroderivative Gas Turbines—Design and Operating Features", M.W. Horner, Aug. 1996.

(List continued on next page.)

*Primary Examiner*—Edward K. Look
*Assistant Examiner*—Richard A. Edgar
(74) *Attorney, Agent, or Firm*—Nixon & Vanderhye P.C.

(57) ABSTRACT

A turbine bucket includes an airfoil extending from a platform, having high and low pressure sides; a wheel mounting portion; a hollow shank portion located radially between the platform and the wheel mounting portion, the platform having an under surface. An impingement cooling plate is located in the hollow shank portion, spaced from the under surface, and the impingement plate is formed with a plurality of impingement cooling holes therein.

17 Claims, 2 Drawing Sheets

OTHER PUBLICATIONS

"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_X$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi, Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.
"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Tubrine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Unites", P. Albert, Aug. 1996.
"39th GE Turbine State–of–the–Art Technology Seminar", Tab 33, "Advances in Welding Repair Technology" J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.

"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.
"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technologies and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995–Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1995.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3–13, Oct., 1995.
"Proceedings of the Advanced Turbine Systems Annual Program Review Meeting", vol. I, "H Gas Turbine Combined Cycle", J. Corman, p. 14–21, Oct., 1995.
"Proceedings of the Advanced Turbine Systems Annual Program Review Meeting", vol. I, "Overview of Westinghouse's Advanced Turbine Systems Program", Bannister et al., p. 22–30, Oct., 1995.
"Proceedings of the Advanced Turbine Systems Annual Program Review Meeting", vol. I, "Allison Engine ATS Program Technical Review", D. Mukavetz, p. 31–42, Oct., 1995.
"Proceedings of the Advanced Turbine Systems Annual Program Review Meeting", vol. I, "Advanced Turbine Systems Program Industrial System Concept Development", S. Gates, p. 43–63, Oct., 1995.
"Proceedings of the Advanced Turbine Systems Annual Program Review Meeting", vol. I, "Advanced Turbine System Program Phase 2 Cycle Selection", Latcovich, Jr., p. 64–69, Oct., 1995.
"Proceedings of the Advanced Turbine Systems Annual Program Review Meeting", vol. I, "General Electric ATS Program Technical Review Phase 2 Activities", Chance et al., p. 70–74, Oct., 1995.
"Proceedings of the Advanced Turbine Systems Annual Program Review Meeting", vol. I, "Technical Review of Westinghouse's Advanced Turbine Systems Program", Diakunchak et al., p. 75–86, Oct., 1995.
"Proceedings of the Advanced Turbine Systems Annual Program Review Meeting", vol. I, "Advanced Combustion Turbines and Cycles: An EPRI Perspective", Touchton et al., p. 87–88, Oct., 1995.
"Proceedings of the Advanced Turbine Systems Annual Program Review Meeting", vol. I, "Advanced Turbine Systems Annual Program Review", William E. Koop, p. 89–92, Oct., 1995.
"Proceedings of the Advanced Turbine Systems Annual Program Review Meeting", vol. I, "The AGTSR Consortium: An Update", Fant et al., p. 93–102, Oct., 1995.
"Proceedings of the Advanced Turbine Systems Annual Program Review Meeting", vol. I, "Overview of Allison/AGTSR Interactions", Sy A. Ali, p. 103–106, Oct., 1995.
"Proceedings of the Advanced Turbine Systems Annual Program Review Meeting", vol. I, "Design Factors for Stable Lean Premix Combustion", Richards et al., p. 107–113, Oct., 1995.
"Proceedings of the Advanced Turbine Systems Annual Program Review Meeting", vol. I, "Ceramic Stationary as Turbine", M. van Roode, p. 114–147, Oct., 1995.
"Proceedings of the Advanced Turbine Systems Annual Program Review Meeting", vol. I, "DOE/Allison Ceramic Vane Effort", Wenglarz et al., p. 148–151, Oct., 1995.
"Proceedings of the Advanced Turbine Systems Annual Program Review Meeting", vol. I, "Materials/Manufacturing Element of the Advanced Turbine Systems Program", Karnitz et al., p. 152–160, Oct., 1995.
"Proceedings of the Advanced Turbine Systems Annual Program Review Meeting", vol. I, "Land–Based Turbine Casting Initiative", Mueller et al., p. 161–170, Oct., 1995.
"Proceedings of the Advanced Turbine Systems Annual Program Review Meeting", vol. I, "Turbine Airfoil Manufacturing Technology", Kortovich, p. 171–181, Oct., 1995.
"Proceedings of the Advanced Turbine Systems Annual Program Review Meeting", vol. I, "Pratt & Whitney Thermal Barrier Coatings", Bornstein et al., p. 182–193, Oct., 1995.
"Proceedings of the Advanced Turbine Systems Annual Program Review Meeting", vol. I, "Westinhouse Thermal Barrier Coatings", Goedjen et al., p. 194–199, Oct., 1995.
"Proceedings of the Advanced Turbine Systems Annual Program Review Meeting", vol. I, "High Performance Steam Development", Duffy et al., p. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., p. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. p. 233–248, Oct., 1995.

"Proceedings of the Advanced Turbine Systems Annual Program Review Meeting", vol. II, "Lean Premixed Flames for Low $No_X$ Combustors", Sojka et al., p. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems", Banovic et al., p. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., p. 281–309, Oct., 1995.

"Proceedings of the Advanced Turbine Systems Annual Program Review Meeting", vol. II, "Life Prediction of Advanced Materials for Gas Turbine Application", Zamrik et al., p. 310–327, Oct., 1995.

"Proceedings of the Advanced Turbine Systems Annual Program Review Meeting", vol. II, "Advanced Combustion Technologies for Gas Turbine Power Plants", Vandsburger et al., p. 328–352, Oct., 1995.

"Proceedings of the Advanced Turbine Systems Annual Program Review Meeting", vol. II, "Combustion Modeling in Advanced Gas Turbine Systems", Smoot et al., p. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371–390, Oct., 1995.

"Proceedings of the Advanced Turbine Systems Annual Program Review Meeting", vol. II, "Rotational Effects on Turbine Blade Cooling", Govatzidakia et al., p. 391–392, Oct., 1995.

"Proceedings of the Advanced Turbine Systems Annual Program Review Meeting", vol. II, "Manifold Methods for Methane Combustion", Yang et al., p. 393–409, Oct., 1995.

"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415–422, Oct., 1995.

"Proceedings of the Advanced Turbine Systems Annual Program Review Meeting", vol. II, "Experimental and Computational Studies of Film Cooling With Compound Angle Injection", Goldstein et al., p. 423–451, Oct., 1995.

"Proceedings of the Advanced Turbine Systems Annual Program Review Meeting", vol. II, "Compatibility of Gas Turbine Materials with Steam Cooling", Desai et al., p. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465–473, Oct., 1995.

"Proceedings of the Advanced Turbine Systems Annual Program Review Meeting", vol. II, Effects of Geometry on Slot–Jet Film Cooling Performance, Hyams et al., p. 474–496 Oct., 1995.

"Proceedings of the Advanced Turbine Systems Annual Program Review Meeting", vol. II, "Steam as Turbine Blade Coolant: Experimental Data Generation", Wilmsen et al., p. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., p. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., p. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., p. 529–538, Oct., 1995.

"Proceedings of the Advanced Turbine Systems Annual Program Review Meeting", vol. II, "Bond Strength and Stress Measurements in Thermal Barrier Coatings", Gell et al., p. 539–549, Oct., 1995.

"Proceedings of the Advanced Turbine Systems Annual Program Review Meeting", vol. II, "Active Control of Combustion Instabilities in Low $NO_X$ Gas Turbines", Zinn et al., p. 550–551, Oct., 1995.

"Proceedings of the Advanced Turbine Systems Annual Program Review Meeting", vol. II, "Combustion Instability Modeling and Analysis", Santoro et al., p. 552–559, Oct., 1995.

"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560–565, Oct., 1995.

"Proceedings of the Advanced Turbine Systems Annual Program Review Meeting", vol. II, "Heat Pipe Turbine Vane Cooling", Langston et al., p. 566–572, Oct., 1995.

"Proceedings of the Advanced Turbine Systems Annual Program Review Meeting", vol. II, "Improved Modeling Techniques for Turbomachinery Flow Fields", Lakshminarayana et al., p. 573–581, Oct., 1995.

"Proceedings of the Advanced Turbine Systems Annual Program Review Meeting", vol. II, "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, p. 3–16, Nov., 1996.

"Proceedings of the Advanced Turbine Systems Annual Program Review Meeting", "Power Needs in the Chemical Industry", Keith Davidson, p. 17–26, Nov., 1996.

"Proceedings of the Advanced Turbine Systems Annual Program Review Meeting", "Advanced Turbine Systems Program Overview", David Esbeck, p. 27–34, Nov., 1996.

"Proceedings of the Advanced Turbine Systems Annual Program Review Meeting", "Westinghouse's Advanced Turbine Systems Program", Gerard McQuiggan, p. 35–48, Nov., 1996.
"Proceedings of the Advanced Turbine Systems Annual Program Review Meeting", "Overview of GE's H Gas Turbine Combined Cycle", Cook et al., p. 49–72, Nov., 1996.
"Proceedings of the Advanced Turbine Systems Annual Program Review Meeting", "Allison Advanced Simple Cycle Gas Turbine System", William D. Weisbrod, p. 73–94, Nov., 1996.
"Proceedings of the Advanced Turbine Systems Annual Program Review Meeting", "The AGTSR Industry–University Consortium", Lawrence P. Golan, p. 95–110, Nov., 1996.
"Proceedings of the Advanced Turbine Systems Annual Program Review Meeting", "$NO_X$ and CO Emissions Models for Gas–Fired Lean–Premixed Combustion Turbines", A. Mellor, p. 111–122, Nov., 1996.
"Proceedings of the Advanced Turbine Systems Annual Program Review Meeting", "Methodologies for Active Mixing and Combustion Control", Uri Vandsburger, p. 123–156, Nov., 1996.
"Proceedings of the Advanced Turbine Systems Annual Program Review Meeting", "Combustion Modeling in Advanced Gas Turbine Systems", Paul O. Hedman, p. 157–180, Nov., 19967.
"Proceedings of the Advanced Turbine Systems Annual Program Review Meeting", "Manifold Methods for Methane Combustion", Stephen B. Pope, p. 181–188, Nov., 1996.
"Proceedings of the Advanced Turbine Systems Annual Program Review Meeting", "The Role of Reactant Unmixedness, Strain Rate, and Length Scale on Premixed Combustor Performance", Scott Samuelsen, p. 189–210, Nov., 1996.
"Proceedings of the Advanced Turbine Systems Annual Program Review Meeting", "Effect of Swirl and Momentum Distribution on Temperature Distribution in Premixed Flames", Ashwani K. Gupta, p. 211–232, Nov., 1996.
"Proceedings of the Advanced Turbine Systems Annual Program Review Meeting", "Combustion Instability Studies Application to Land–Based Gas Turbine Combustors", Robert J. Santoro, p. 233–252.
"Proceedings of the Advanced Turbine Systems Annual Program Review Meeting", Active Control of Combustion Instabilities in Low $NO_X$ Turbines, Ben T. Zinn, p. 253–264, Nov., 1996.
"Proceedings of the Advanced Turbine Systems Annual Program Review Meeting", "Life Prediction of Advanced Materials for Gas Turbine Application," Sam Y. Zamrik, p. 265–274, Nov., 1996.
"Proceedings of the Advanced Turbine Systems Annual Program Review Meeting", "Combustion Chemical Vapor Deposited Coatings for Thermal Barrier Coating Systems", W. Brent Carter, p. 275–290, Nov., 1996.
"Proceedings of the Advanced Turbine Systems Annual Program Review Meeting", "Compatibility of Gas Turbine Materials with Steam Cooling", Vimal Desai, p. 291–314, Nov., 1996.
"Proceedings of the Advanced Turbine Systems Annual Program Review Meeting", "Bond Strength and Stress Measurements in Thermal Barrier Coatings", Maurice Gell, p. 315–334, Nov., 1996.
"Proceedings of the Advanced Turbine Systems Annual Program Review Meeting", "Advanced Multistage Turbine Blade Aerodynamics, Performance, Cooling and Heat Transfer", Sanford Fleeter, p. 335–356, Nov., 1996.
"Proceedings of the Advanced Turbine Systems Annual Program Review Meeting", "Flow Characteristics of an Intercooler System for Power Generating Gas Turbines", Ajay K. Agrawal, p. 357–370, Nov., 1996.
"Proceedings of the Advanced Turbine Systems Annual Program Review Meeting", "Improved Modeling Techniques for Turbomachinery Flow Fields", B. Lakshiminarayana, p. 371–392, Nov., 1996.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393–406, Nov., 1996.
"Proceedings of the Advanced Turbine Systems Annual Program Review Meeting", "Advanced Turbine Cooling, Heat Transfer, and Aerodynamic Studies", Je–Chin Han, p. 407–426, Nov., 1996.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427–446.
"Proceedings of the Advanced Turbine Systems Annual Program Review Meeting", "Experimental and Computational Studies of Film Cooling with Compound Angle Injection", R. Goldstein, p. 447–460, Nov., 1996.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461–470, Nov., 1996.
"Proceedings of the Advanced Turbine Systems Annual Program Review Meeting", "Steam as a Turbine Blade Coolant: External Side Heat Transfer", Abraham Engeda, p. 471–482, Nov., 1996.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483–498, Nov., 1996.
"Proceedings of the Advanced Turbine Systems Annual Program Review Meeting", "Closed–Loop Mist/Steam Cooling for Advanced Turbine Systems", Ting Wang, p. 499–512, Nov., 1996.
"Proceedings of the Advanced Turbine Systems Annual Program Review Meeting", "Heat Pipe Turbine Vane Cooling", Langston et al., p. 513–534, Nov., 1996.
"Proceedings of the Advanced Turbine Systems Annual Program Review Meeting", "EPRI's Combustion Turbine Program: Status and Future Directions", Arthur Cohn, p. 535,–552 Nov., 1996.
"Proceedings of the Advanced Turbine Systems Annual Program Review Meeting", "ATS Materials Support", Michael Karnitz, p. 553–576, Nov., 1996.
"Proceedings of the Advanced Turbine Systems Annual Program Review Meeting", "Land Based Turbine Casting Initiative", Boyd A. Mueller, p. 577–592, Nov., 1996.
"Proceedings of the Advanced Turbine Systems Annual Program Review Meeting", "Turbine Airfoil Manufacturing Technology", Charles S. Kortovich, p. 593–622, Nov., 1996.

"Proceedings of the Advanced Turbine Systems Annual Program Review Meeting", "Hot Corrosion Testing of TBS's", Norman Bornstein, p. 623–631, Nov., 1996.
"Proceedings of the Advanced Turbine Systems Annual Program Review Meeting", "Ceramic Stationary Gas Turbine", Mark van Roode, p. 633–658, Nov., 1996.
"Proceedings of the Advanced Turbine Systems Annual Program Review Meeting", "Western European Status of Ceramics for Gas Turbines", Tibor Bornemisza, p. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date, May 1, 1997, Report Nos: DOE/MC/31176—5340.
"Utility Advanced Turbine System (ATS) Technology Readiness Testing and Pre–Commercial Demonstration—Phase 3", Document #486132, Apr. 1–Jun. 30, 1976, Publication Date, Dec. 31, 1996, Report Nos: DOE/MC/31176—5660.
"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos: DOE/MC/31176—5339.
"Utility Advanced Turbine System (ATS) Technology Readiness Testing and Pre–Commercial Demonstration" Document #666277, Apr. 1–Jun. 30, 1997, Publication Date, Dec. 31, 1997, Report Nos: DOE/MC/31176—8.
"Utility Advanced Turbine System (ATS) Technology Readiness Testing and Pre–Commercialization Demonstration" Jan. 1–Mar. 31, 1996, DOE/MC/31176—5338.
"Utility Advanced Turbine System (ATS) Technology Readiness Testing: Phase 3R", Document #756552, Apr. 1–Jun. 30, 1999, Publication Date, Sep. 1, 1999, Report Nos: DE—FC21–95MC31176–23.
"Utility Advanced Turbine System (ATS) Technology Readiness Testing.", Document #656823, Jan. 1–Mar. 31, 1998, Publication Date, Aug. 1, 1998, Report Nos: DOE/MC/31176–17.
"Utility Advanced Turbine System (ATS) Technology Readiness Testing and Pre–Commercial Demonstration", Annual Technical Progress Report, Reporting Period: Jul. 1, 1995–Sep. 30, 1996.
"Utility Advanced Turbine Systems (ATS) Technology Readiness Testing", Phase 3R, Annual Technical Progress Report, Reporting Period: Oct. 1, 1997–Sep. 30, 1998.
"Utility Advanced Turbine Systems (ATS) Technology Readiness Testing", Document #750405, Oct. 1–Dec. 30, 1998, Publication Date: May, 1, 1999, Report Nos: DE–FC21–95MC31176–20.
"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.
"Utility Advanced Turbine Systems (ATS) Technology Readiness Testing—Phase 3", Annual Technical Progress Report, Reporting Period: Oct. 1, 1996–Sep. 30, 1997.
"Utility Advanced Turbine Systems (ATS) Technology Readiness Testing and Pre–Commercial Demonstration", Quarterly Report, Jan. 1–Mar. 31, 1997, Document #666275, Report Nos: DOE/MC/31176–07.
"Proceedings of the 1997 Advanced Turbine Systems", Annual Program Review Meeting, Oct. 28–29, 1997.

* cited by examiner

BUCKET PLATFORM COOLING SCHEME AND RELATED METHOD

This invention was made with Government support under Contract No. DE-FC21-95MC31176 awarded by the Department of Energy. The Government has certain rights in this invention.

This invention relates to the cooling of gas turbine components and, more specifically, to the cooling of platform areas of gas turbine buckets.

BACKGROUND OF THE INVENTION

Turbine buckets include an airfoil region and a hollow base or shank portion radially between the airfoil and an assembly end such as a dovetail by which the bucket is secured to a turbine rotor wheel. A relatively flat platform lies at the base of the airfoil and forms the top surface or wall of the hollow shank portion.

The airfoil has leading and trailing edges, and pressure and suction sides. The airfoil is exposed to the hot combustion gases, and internal cooling circuits within the airfoil itself are commonly employed, but are not part of this invention. Here, it is cooling of the bucket platform that is of concern.

Low Cycle Fatigue (LCF) is one of the failure mechanisms common to all gas turbine high-pressure buckets. Low cycle fatigue is a function of both stress and temperature. The stress may arise from the mechanical loading, or it may be thermally induced. Diminishing the thermal gradients in order to increase LCF life of the component, by incorporating optimal cooling schemes, is a challenge encountered by gas turbine component designers.

While the platform area on the external gas path side of the bucket is being exposed to hot gas temperatures, the bottom of the platform is subjected to relatively low temperatures due to the air leaking from the forward rotor wheel space through a radial pin. This temperature difference between the bottom and top of the platform leads to a large thermal gradient and high stress field and therefore requires an optimal cooling scheme to reduce the thermal stresses in the platform area.

BRIEF SUMMARY OF THE INVENTION

This invention relates to a unique methodology in designing the required bucket platform cooling hardware, including an impingement plate located within the hollow bucket shank, beneath the bucket platform. The impingement plate is spaced a substantially uniform distance from the surface (i.e., the target surface), and includes an optimized array of impingement cooling holes divided by a rib to thereby establish impingement zones on the pressure side of the bucket platform.

The cooling methodology consists of air being fed by wheelspace flow which is pumped up toward and through the plate, with the post-impingement flow being discharged via optimally located rows of film holes drilled through the platform wall, also on the pressure side of the bucket.

The invention includes systematically defining the most efficient combination of hole diameters, hole spacing and the optimal separation distance of the impingement plate from the cooled platform under-surface. The rib bifurcating the impingement zones is designed to diminish the impact of two-dimensional cross-flow degradation on the local heat transfer coefficients. Subdividing the target surface into three different impingement zones also aids in the following:

(a) Controlling the static pressure variation in the post-impingement region.

(b) Controlling the momentum flux between the jet flow and cross-stream flow; and (c) Optimizing the required magnitude of the heat transfer coefficients based on the varying thermal stress distribution of the target surface.

In addition to the cooling configuration and optimized jet array in the impingement plate, the platform wall itself is optimized for a varying wall thickness configuration. In order to balance the stress distribution on the pressure side of the platform and airfoil-platform fillet area, the platform thickness is varied along the axial direction. A lower uniform thickness on the leading edge side of the platform, and a higher uniform thickness on the trailing edge of the platform has been proved to be the best configuration, based on experimental studies. The platform thickness along the tangential direction may or may not be varied.

Accordingly, in one aspect, the invention relates to a turbine bucket comprising an airfoil extending from a platform, having high and low pressure sides; a wheel mounting portion; a hollow shank portion located radially between the platform and the wheel mounting portion, the platform having an under surface; and an impingement cooling plate located in the hollow shank portion, spaced from the under surface, the impingement plate having a plurality of impingement cooling holes therein.

In another aspect, the invention relates to a gas turbine bucket comprising an airfoil extending from a platform, having high and low pressure sides; a wheel mounting portion; a hollow shank portion located radially between the platform and the wheel mounting portion, the platform having an under surface; means for enabling impingement cooling of the under surface, and means for discharging cooling air from the hollow shank portion.

In still another aspect, the invention relates to a method of cooling a turbine bucket platform located radially between an airfoil and a mounting portion, the platform forming a radially outer wall of a hollow shank portion comprising fixing an impingement cooling plate within the hollow shank portion, spaced from an under surface of the platform, the impingement cooling plate having a plurality of impingement cooling holes therein; providing discharge holes in the platform; and directing turbine wheelspace air flow through the impingement cooling holes and the discharge holes in the platform.

DETAILED DESCRIPTION OF THE INVENTION

Figure 1:
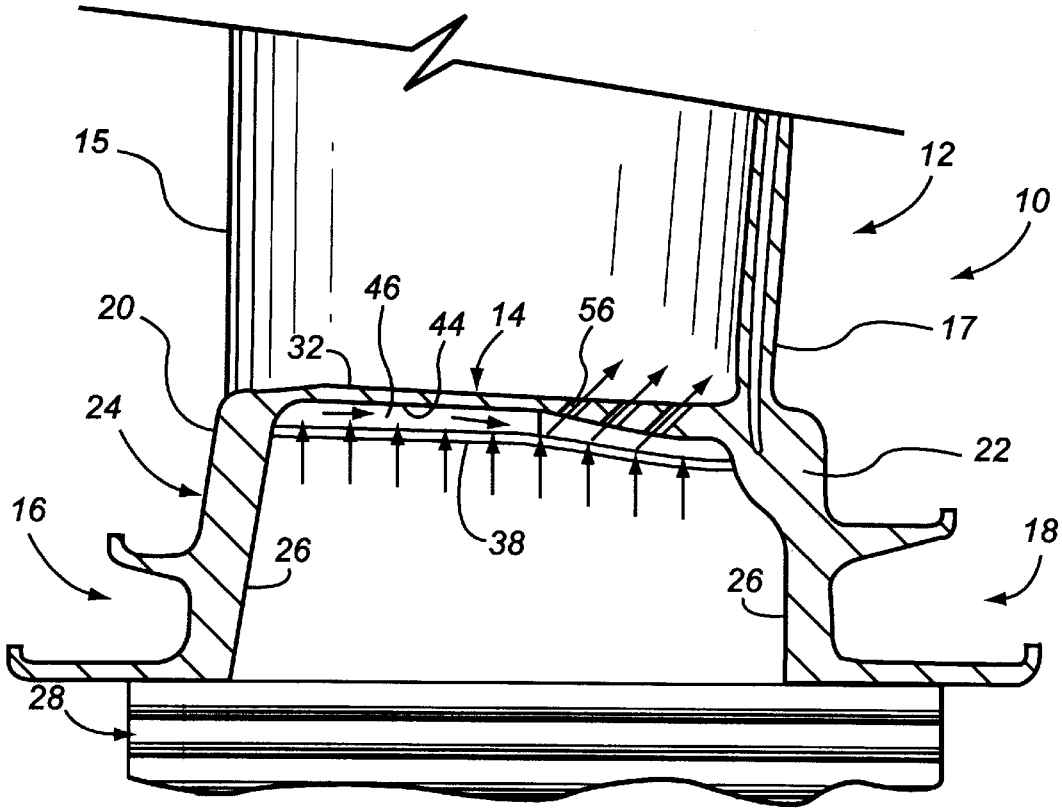
FIG. 1 is a partial elevation, partly in section, of a gas turbine bucket, illustrating an impingement plate in the hollow shank portion of the bucket.
Figure 2:
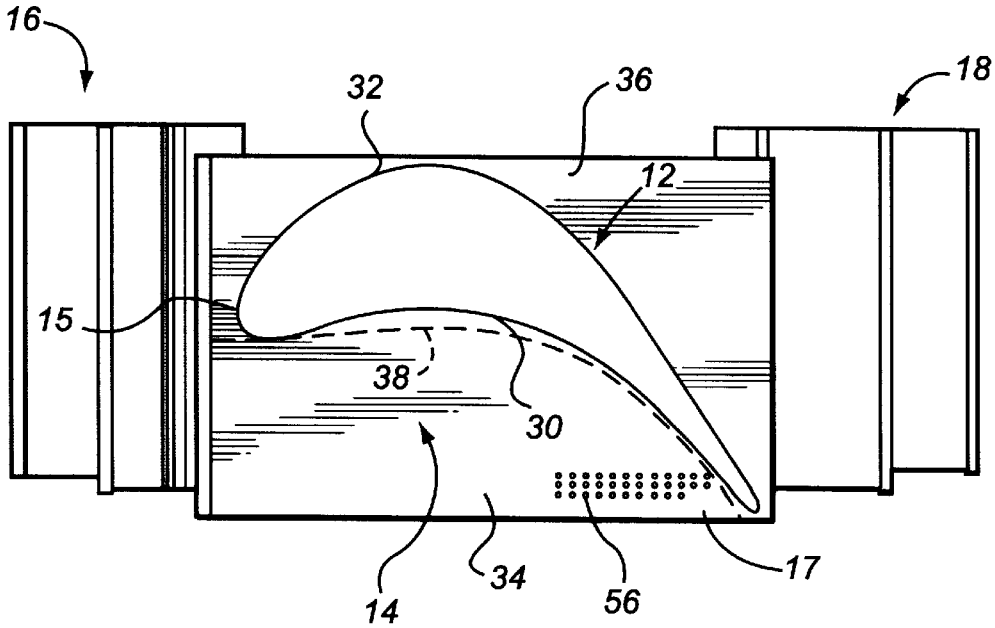
FIG. 2 is a plan view of the bucket illustrated in FIG. 1, and showing generally, in phantom, the impingement plate within the shank portion of the bucket.

With reference initially to FIGS. 1 and 2, a turbine bucket 10 includes an airfoil 12 extending vertically upwardly from a horizontal, substantially planar platform 14. The airfoil portion has a leading edge 15 and a trailing edge 17. Below the platform 14, there are two pair of so-called "angel wings" 16, 18 extending in opposite directions from the leading and trailing sides 20, 22 of the root or shank portion 24 of the bucket. The platform 14 is joined with and forms part of the shank portion 24 that also includes side walls or skirts 26. Below the hollow shank portion, there is a dovetail 28 (only partially shown) by which the bucket is secured to a turbine wheel (in a preferred embodiment, the stage 1 or stage 2 wheels of a gas turbine).

Figure 3:
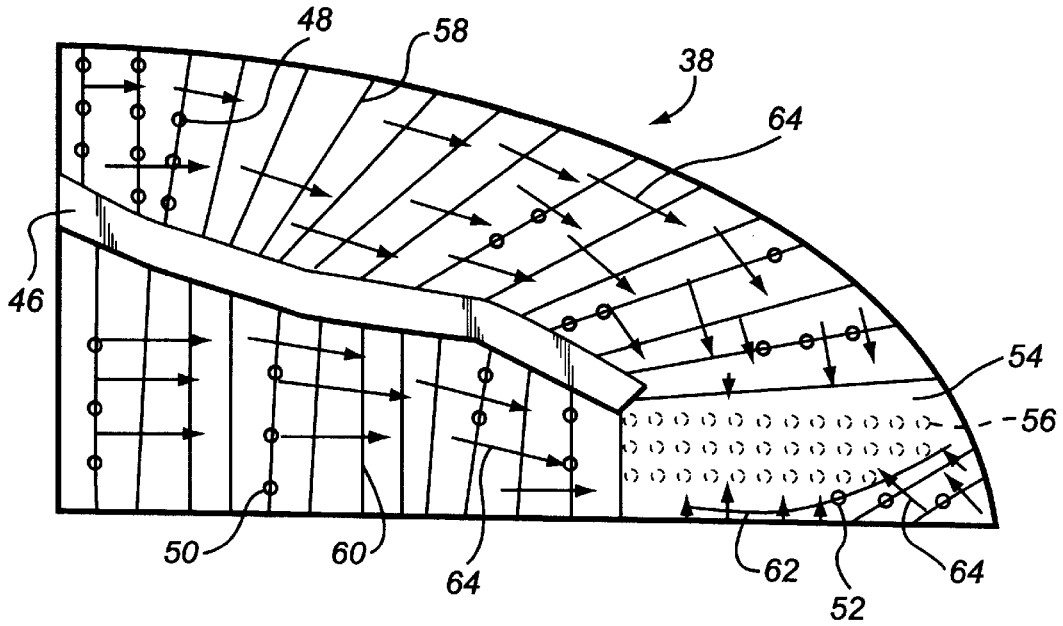
FIG. 3 is a plan view of the impingement plate in accordance with the invention.
Figure 4:
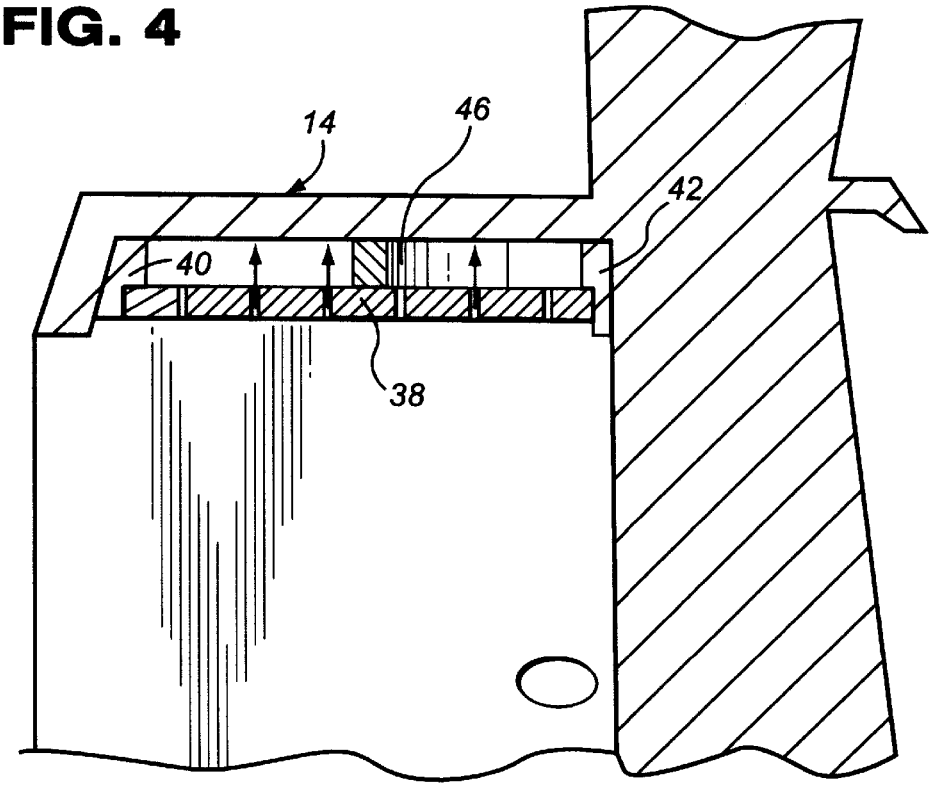
FIG. 4 is a partial side section of the bucket shown in FIG. 2.

The airfoil 12 has a high pressure side 30 and a low pressure side 32, and thus, platform 14 also has a high pressure side 34 and a low pressure side 36. The hollow shank portion 24 lies directly and radially beneath the platform, and within that hollow shank portion, an impingement plate 38 is fixed (by brazing or other appropriate means) to the interior of the shank portion along integral ledges or shoulders 40, 42 (see FIG. 4) on the undersurface 44 of the platform that conform to the outer periphery of the plate. As illustrated in FIG. 3, the impingement plate is relatively close to the undersurface 44 of the platform 14, and generally conforms thereto such that the distance between the impingement plate 38 and the undersurface 44 of the platform 14 remains substantially constant.

The impingement plate 38 is best seen in FIG. 3, illustrating a plan view thereof. The plate 38 is bifurcated generally by an upstanding rib 46, the thickness of which conforms to the spacing between the platform undersurface and the plate. Such spacing may be between about 0.10" and 0.30", and preferably about 0.20".

The plate 38 is formed with a first array or zone of impingement holes or jets 48 closest to the airfoil; a second array or zone of impingement holes or jets 50 on the other side of rib 46, remote from the airfoil; and a third array or zone of impingement holes or jets 52 in a corner of the plate 38, proximate the trailing edge 17 of the airfoil. As can be seen from FIG. 3, these three arrays of holes surround a blank area 54 of the plate that lies directly beneath the array of film cooling holes 56 formed in the platform 14 (shown in phantom in FIG. 3) to facilitate an understanding of the spatial relationship between the impingement holes in the plate 38 and the film holes in the platform 14. It will be appreciated that all of the impingement holes are not shown in FIG. 3, nor are the few holes illustrated drawn to scale. Nevertheless, arrays of lines 58, 60 and 62 represent centerlines of rows of holes in each of the respective arrays. Flow arrows 64 indicate the direction of flow of cooling air after passing through the impingement plate 38, along the undersurface of the platform, toward the discharge location at the film cooling holes 56 in the platform 14.

The holes in each array are spaced from each other in a given row in a "span-wise" direction, while the rows themselves are spaced in a "flow-stream" direction. Depending upon the particular application, the spacing in both directions may vary. In one example, spacing of rows in the flow-stream direction may vary between 0.16 and 0.43 inch. Spacing of holes in the span-wise direction may vary between 0.14 and 0.27 inch.

All of the impingement cooling holes 48, 50, 52 in the impingement plate are drilled perpendicular to the upper and lower surfaces of the plate, and may have diameters of about 0.020 inch. The film cooling holes 56 are drilled through the platform at an angle, to promote attachment to the platform surface, thus providing an additional cooling function.

By judicious selection of impingement hole diameters; spacing in both span-wise and flow-stream directions; as well as the optimal separation distance between the impingement plate 38 and the under surface 44 of the platform 14, several benefits are obtained. For example, the total pressure drop across the impingement plate can be minimized, and high heat transfer coefficient distribution on the target surface (i.e., under surface 44) can be achieved by also controlling the momentum flux (by decreasing the impact of cross-flow degradation of the jet array configuration).

Moreover, the incorporation of rib 46 that bifurcates the impingement zones as defined by the respective arrays of holes 48, 50 and 52, diminishes the impact of two-dimensional cross-flow degradation on the local heat transfer coefficients. This also helps in diminishing deflection of the plate 40 due to the pressure ratio across the plate as well as the centrifugal loading due to the influence of the rotation field.

In addition to the cooling configuration and optimized jet array and impingement plate configuration, the wall of the platform 14 itself is optimized via a varying wall thickness configuration. In order to balance the stress distribution on the pressure side of the platform and airfoil-platform fillet area, the platform thickness is varied along the axial direction as best seen in FIG. 1. A lower uniform thickness on the leading edge side of the platform (e.g., 0.160 inch), a higher uniform thickness on the trailing edge of the platform (e.g., 0.380 inch) and in-between variation around the center of the platform has been proved to be the best configuration based on the experimental studies. This specific platform geometric configuration in conjunction with the described cooling arrangement is believed to provide the best LCF life.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

an airfoil extending from a platform, having high and low pressure sides;

a wheel mounting portion;

a hollow shank portion located radially between the platform and the wheel mounting portion, said platform having an under surface; and an impingement cooling plate located in said hollow shank portion, said impingement plate located along a high pressure side of the airfoil, spaced from said under surface, said impingement plate formed with plural discrete arrays of impingement cooling holes, said impingement plate also including a blank area without impingement holes located proximate to a trailing edge of said airfoil and substantially surrounded by said discrete arrays of impingement cooling holes, wherein said platform is formed with an array of film cooling holes adapted to discharge air from said hollow shank portion, said array of film cooling holes substantially aligned with said blank area of said impingement plate.

2. The turbine bucket of claim 1 and further including an elongated rib between said under surface and said impingement plate, dividing said impingement plate into plural impingement zones.

3. The turbine bucket of claim 1 wherein said impingement holes are substantially normal to upper and lower surfaces of said impingement plate.

4. The turbine bucket of claim 1 wherein said impingement plate is spaced from said under surface of said platform by about 0.10" to about 0.30".

5. The turbine bucket of claim 1 wherein said impingement cooling holes have diameters of about 0.020 inch.

6. A method of cooling a turbine bucket platform located radially between an airfoil and a mounting portion, said platform forming a radially outer wall of a hollow shank portion comprising:

forming said platform to have a thickness that is greater on a trailing edge side thereof than on a leading edge side thereof;

fixing an impingement cooling plate within said hollow shank portion, spaced from an under surface of said platform, said impingement cooling plate having a plurality of impingement cooling holes therein;

providing discharge holes in said platform; and directing turbine wheelspace air flow through said impingement cooling holes and said discharge holes in said platform.

7. The method of claim 6 wherein said impingement plate is formed with plural, discrete arrays of said impingement cooling holes.

8. The method of claim 6 wherein said impingement holes are substantially normal to upper and lower surfaces of said impingement plate.

9. The method of claim 7 wherein said impingement plate includes a blank area without impingement holes, and wherein said platform is formed with an array of film cooling holes adapted to discharge air from said hollow shank portion, said array of film cooling holes substantially aligned with said blank area of said impingement plate.

10. The method of claim 6 wherein said impingement plate is formed with plural, discrete arrays of said impingement cooling holes; and wherein said impingement plate includes a blank area without impingement holes, and wherein said platform is formed with an array of film cooling holes adapted to discharge air from said hollow shank portion, said array of film cooling holes substantially aligned with said blank area of said impingement plate; and further wherein said impingement plate is located radially inward of said high pressure side of said airfoil.

11. A turbine bucket comprising:

an airfoil extending from a platform, having high and low pressure sides;

a wheel mounting portion;

a hollow shank portion located radially between the platform and the wheel mounting portion, said platform having an under surface; and an impingement cooling plate located in said hollow shank portion, spaced from said under surface, said impingement plate formed with plural, discrete arrays of impingement cooling holes; and wherein said platform has a thickness that is greater on a trailing edge side of the platform than on a leading edge side of the platform.

12. The turbine bucket of claim 11 and further including an elongated rib between said under surface and said impingement plate, dividing said impingement plate into plural impingement zones.

13. The turbine bucket of claim 11 wherein said impingement holes are substantially normal to upper and lower surfaces of said impingement plate.

14. The turbine bucket of claim 11 wherein said impingement plate includes a blank area without impingement holes, and wherein said platform is formed with an array of film cooling holes adapted to discharge air from said hollow shank portion, said array of film cooling holes substantially aligned with said blank area of said impingement plate.

15. The turbine bucket of claim 11 wherein said impingement plate is spaced from said under surface of said platform by about 0.10" to about 0.30".

16. The turbine bucket of claim 11 wherein said impingement cooling holes have diameters of about 0.020 inch.

17. The turbine bucket of claim 11 wherein said impingement plate is located radially inward of said high pressure side of said airfoil.

* * * * *